United States Patent [19]

Bojicic

[11] Patent Number: 4,461,482

[45] Date of Patent: Jul. 24, 1984

[54] MULTIPLE IMPACT PUTTER

[76] Inventor: Savo Bojicic, 2350 Bridletowne Circle #2309, Scarborough, Ontario, Canada, M1W 3E6

[21] Appl. No.: 410,941

[22] Filed: Aug. 24, 1982

[51] Int. Cl.[3] ..... A63B 69/36; A63B 53/08; A63B 53/04

[52] U.S. Cl. ..... 273/183 D; 273/168; 273/78; 273/175; 273/164

[58] Field of Search ..... 273/168, 167 J, 167 K, 273/167 R, 167 B, 167 D, 167 E, 167 G, 171, 172, 173, 175, 78, 183, 164; D21/217-219, 183 E, 183 D, 186 A, 186 E

[56] References Cited

U.S. PATENT DOCUMENTS

| | | | |
|---|---|---|---|
| 1,437,463 | 12/1922 | Boye | 273/175 X |
| 2,174,212 | 9/1939 | Newsome | D21/217 |
| 2,386,552 | 10/1945 | Hill | 273/173 X |
| 4,136,877 | 1/1979 | Antonious | 273/183 D X |
| 4,139,198 | 2/1979 | Kanavas | 273/186 A |

FOREIGN PATENT DOCUMENTS

| | | | |
|---|---|---|---|
| 7550 | of 1900 | United Kingdom | 273/167 B |
| 23845 | of 1906 | United Kingdom | 273/78 |

*Primary Examiner*—George J. Marlo

[57] ABSTRACT

The present invention relates to a putter having a unique putter head characterized by vertically separated ball striking face portions. These face portions are arranged so that the golf ball can be struck in either one of two manners, including striking the golf ball with a single face portion or striking the golf ball simultaneously with two adjacent face portions with both of these manners producing a straight rolling putt to make the putter adaptable to different players having different putting styles. The putter head also includes vertically oriented sighting apertures which enable the head of the golfer to be properly positioned over the golf ball in the best position to produce a good putt.

11 Claims, 10 Drawing Figures

MULTIPLE IMPACT PUTTER

FIELD OF THE INVENTION

The present invention relates to a putter having a unique putting head arrangement in which the face of the putting head is divided into a plurality of horizontally extending separated face portions allowing different types of impacts with the ball to produce a desired straight line type roll regardless of a particular golfer's style.

BACKGROUND OF THE INVENTION

Putting is one of the most intricate and important aspects of the game of golf with the most important single golf club in every golfer's bag being the putter. Since the object of the game of golf is to knock the golf ball into the hole from the tee off area in the fewest number of strokes, a short putt is as important as a long drive. Furthermore, the putter as opposed to any other golf club is used on every hole on a golf course unless the player unexpectly knocks the ball into the hole from off the green.

There are many reasons for missing a putt and some of these reasons such as the condition and contour of the green cannot be controlled by the golfer. It is therefore very critical to take best advantage of the aspects of putting that can be controlled. It is further very important that the golfer have a putter which produces the proper type of roll for that particular player regardless of his or her bad putting habits.

Most conventional putters have a flat putting face from which it is often difficult to hit the ball on a straight line without imparting an undesirable side spin to the ball. The more sidespin imparted the more the ball tends to roll away from its intended target, particularly in view of spike marks and debris on the green which accentuate misdirection of the ball due to the sidespin. Furthermore, there are many instances in which a golfer may not have the putter properly aligned with the hole which will almost inevitably ruin the putt.

SUMMARY OF THE PRESENT INVENTION

The present invention relates to a putter head for use in a putter in which the head is adapted to mitigate many of the difficulties encountered with prior art putters. More specifically, the putter head of the present invention has a ball striking face comprising a plurality of horizontally extending vertically separated face portions. These face portions are arranged for striking a golf ball in either a single face portion impact mode or in multiple face portion impact mode where at least two face portions simultaneously strike the ball. The face portions are designed such that according to both impact modes the ball is given a substantially straight roll on the line in which it is putting with minimal sidespin.

Striking the ball in the single face impact mode will produce an immediate vertical spinning of the ball as it comes off the putter face while striking of the ball in the multiple face portion impact mode will provide an initial pushing with a delayed vertical spinning of the ball. The vertical spin imparted to the ball tends to substantially eliminate any sidespin so that the ball rolls straight and true relatively unaffected by everpresent spike marks and the like on the putting surface.

According to an aspect of the present invention the putter head is provided with a sight for proper vertical alignment of the putter to assure that the person using the putter has the putter head properly positioned relative to the intended putting line and has his or her head properly positioned over the putter for accurate putting of the ball.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
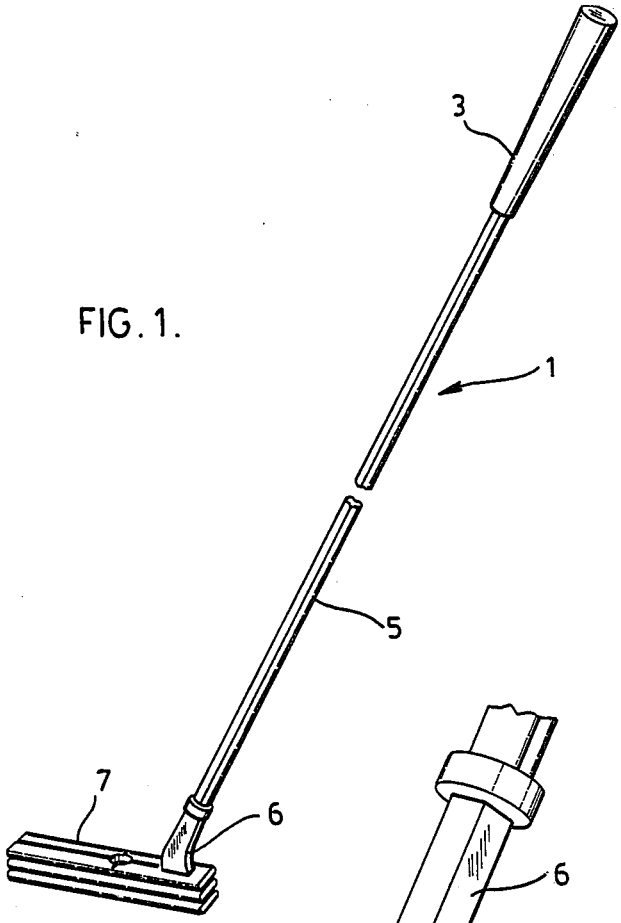
FIG. 1 is a perspective view of a putter having a putter head made in accordance with a preferred embodiment of the present invention.
Figure 2:
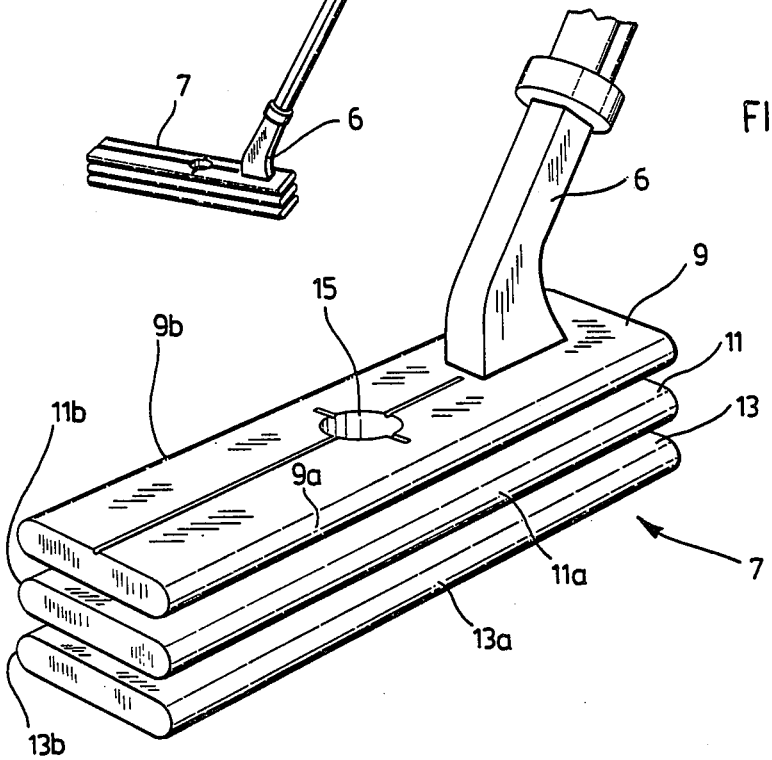
FIG. 2 is an enlarged perspective view of the putter head shown in FIG. 1.

FIG. 1 shows a putter generally indicated at 1 comprising a shaft 5 having a grip 3 at one end and a putter head 7 at the other end connected to the shaft by means of shaft portion 6.

The putter head itself is formed from a plurality of elongated bars vertically stacked and separated with respect to one another other than at the shaft portion 6 which interconnects the upper bar 9, the middle bar 11 and the lower bar 13. Each of these bars is provided with a convex or rounded outer edge to either side of each bar as indicated at *9a*, *11a* and *13a* on one side of the putter head and at *9b*, *11b* and *13b* on the other side of the putter head. These rounded edges form a ridge-like surface on opposing faces or sides of the putter head with each edge presenting a separate and distinct face portion vertically aligned with each of the other edges on each face. As will be seen from the drawings the head is totally symmetrical from one side to the other and can be used for either right or left handed putting.

Figure 3:
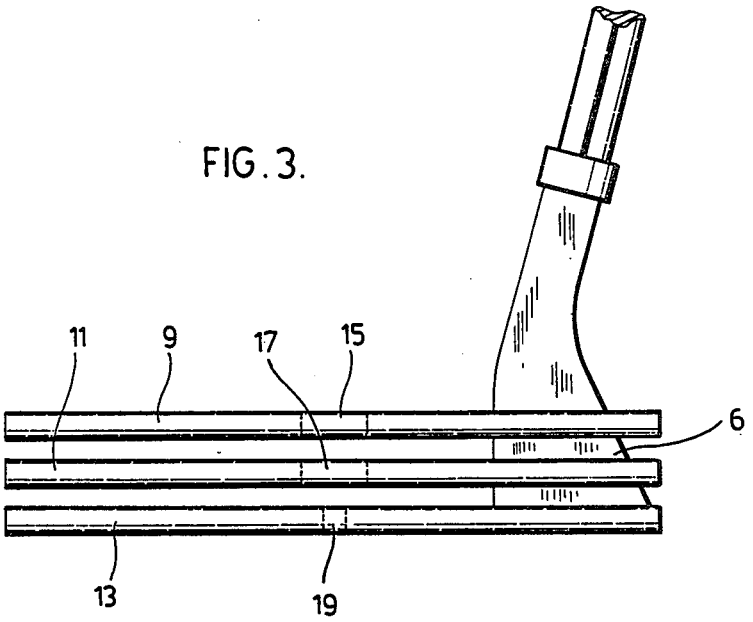
FIG. 3 is a side view of the putter head shown in FIG. 2.
Figure 5:
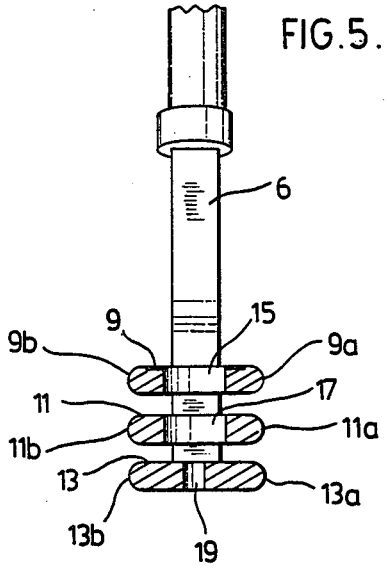
FIG. 5 is a sectional view taken along the lines 5—5 of FIG. 4.
Figure 4:
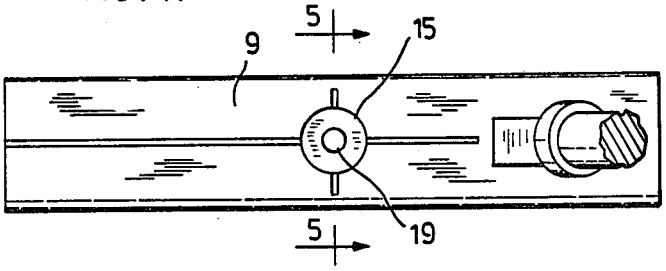
FIG. 4 is a top view of the putter head of FIG. 2.

The putter head also includes a sight for proper vertical positioning of the putter. This sight, best seen in FIGS. 3 and 5, comprises a first rounded aperture 15 in the upper bar member 9, a second rounded aperture 17 in the middle bar member 11 and a smaller aperture 19 in the lower bar member 13. As is well shown in FIG. 4, the upper aperture is bordered by a cross hair arrangement.

In order to effectively use the sight the putter is adjusted until the smaller aperture 19 is centered with respect to the upper aperture 15 through the use of the cross hairs. Once the sight has been properly adjusted, the person using the putter is assured of proper vertical positioning of the putter where the putter head is substantially flush to the putting surface. Furthermore, when looking down on the centered sight, which is the "sweet spot" on the putter head, the head of the golfer is directly over the golf ball in the best position to produce a good butt.

Proper vertical positioning of the putter helps to minimize pushing and pulling of the putt as well as hook and slice spinning of the ball as it leaves the putter face.

Therefore the sight arrangement described above when properly adjusted is extremely effective for producing a straight rolling putt by substantially reducing the likelihood of pushing, pulling and undesirably side spinning the putt.

Different golfers have different putting styles. For example, some golfers underspin a putt which reduces rolling while other golfers overspin a putt for maintaining roll on the ball. Most golfers wish to produce a putt which rolls the golf ball immediately off the putter face while others may strike the ball such that it is initially pushed off the putter face without spin until it has picked up the contour of the green. The putter of the present invention is capable of meeting all of these putting styles.

Furthermore, each putting style can be reproduced from one putt to the next by maintaining a constant stroke action from putt to putt.

FIGS. 6 through 10 show the different ways in which a golf ball can be struck with the putter head of FIGS. 1 through 5. These ways of striking the ball include both a single bar edge impact with the ball and a multiple simultaneous bar edge impact with the ball.

Figure 6:
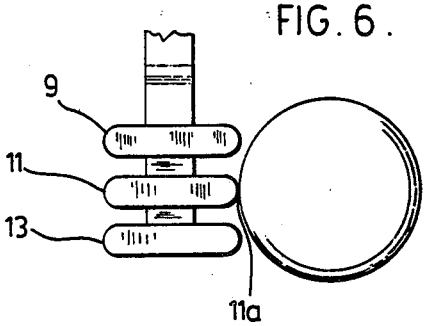
FIGS. 6 through 10 are end views of the putter head of FIG. 2 in various different ball striking positions.

In FIG. 6 it will be seen that the ball is struck such that only the outer rounded edge 11*a* of the central bar 11 comes into contact with the ball at approximately its mid point. With this striking action which is produced by a horizontal swinging motion with the putter head lifted slightly from the putting surface, the ball spins vertically immediately off the putter face in a straight line at substantially right angles to the putter head.

Figure 7:
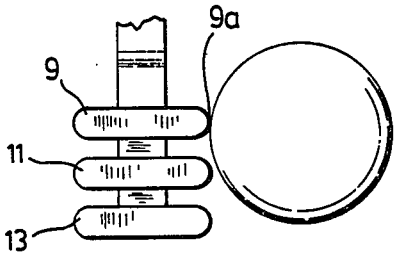

FIG. 7 shows a striking of the ball in which only the outer edge 9*a* of the upper bar 9 comes into contact with the golf ball slightly above its mid point. This is caused by a downward stroking action of the putter with the putter head close to the putting surface to produce a straight roll perpendicular to the putter head with underspin on the ball to reduce rolling distance.

Figure 8:
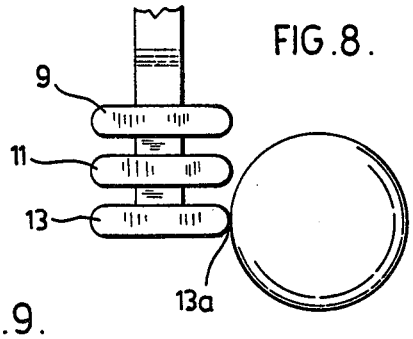

FIG. 8 on the other hand, shows an upward hitting action with the putter head lifted from the putting surface where only the outer edge 13*a* of the lower bar member 13 comes into contact with the golf ball slightly below its mid point. In this instance the ball again immediately rolls off the putter face at substantially right angles to the bar but with overspin causing the ball to roll a greater distance without changing direction which would otherwise occur when striking spike mark or small particles of debris inevitably found on the putting surface.

Figure 9:
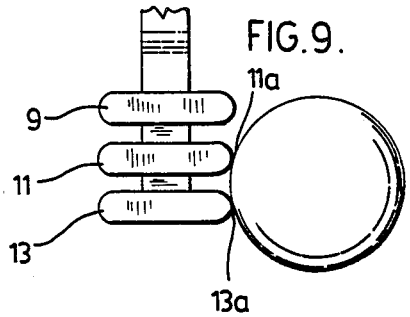
Figure 10:
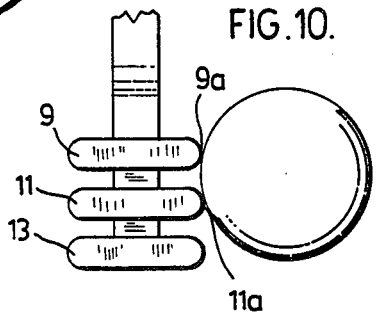

FIGS. 9 and 10 show multiple edge impact modes, between the putter head and the golf ball. In FIG. 9 outer edges 11*a* and 13*a* come into contact with the golf ball with a slightly upward hitting direction and the putter head lifted slightly from the putting surface. The ball is pushed off the putter face without any roll whatsoever until its momentum takes over to produce a true rolling of the ball on line with its target with a strong vertical rotation resisting deviation from that line. This type of multiple impact again produces a long rolling rolling putt.

FIG. 10 shows simultaneous striking of the golf ball with the outer edge portions 9*a* and 11*a* of the upper and central bar members 9 and 11 respectively. This type of putt is produced with a slight downward hitting direction with the putter head at substantially ground level. The putt again is initially pushed off the putter face without roll until the ball assumes a rolling action on line to the target with strong vertical rotation resisting deviation from that line. However, as a result of the downward hitting direction, this type of putt will produce a somewhat shorter roll on the ball than that described with respect to FIG. 9.

Regardless of the type of multiple edge impact made the putt is assured of being straight with a true roll towards the hole. Furthermore, where the ball is struck with only one bar the putt will still have a vertical rolling action due to the small rounding on each of the outer edges of the bars so that a good putt is produced no matter how the ball is struck and regardless of the players bad habits. Since the ball rolls true and straight there is little likelihood of the ball spinning out of the hole or changing direction by spike marks present on all putting surfaces as can often occur when using a conventional putter with which it is difficult to consistently produce a rolling action on the ball.

Although various preferred embodiments have been described herein in detail it will be appreciated by those skilled in the art that variations may be made thereto without departing from the spirit of the invention or the scope of the appended claims.

The embodiments of the invention in which an exclusive property or privilege is claimed are defined as follows:

1. A putter having a putter head comprising a plurality of thin bar members vertically stacked with respect to one another and having opposing horizontally extending outer edges forming right and left hand putting faces on said putter head, said outer edges being gapped at said right and left hand putting faces for impacting a golf ball in either one of two different modes including a single bar edge impact mode and a multiple bar edge impact mode, said outer edges being arranged such that both of said impact modes impart a vertical spin to the golfball.

2. A putter as claimed in claim 1, wherein said putter head comprises an upper, a middle and a lower bar member and a vertical sight formed in the bar members, said vertical sight comprising aligned apertures in said upper and middle bar members and a visual indicator in said lower bar member for centering with respect to the aperture in said upper bar member to indicate proper vertical positioning of said putter.

3. A putter as claimed in claims 1 or 2, wherein said outer edges of said bar members are rounded for imparting a rolling action to a golf ball struck by said putter head.

4. For use in a putter, a putter head formed from a plurality of putter sections having spaced apart edge regions for forming ridges on opposing faces of said putter head for balancing thereof and for both right and left handed putting, said ridges being substantially parallel to and vertically gapped from one another to provide separate and distinct impact surfaces on said putter head for impacting a golf ball in either one of two different modes including a single ridge impact mode and a multiple ridge impact mode where at least two ridges substantially simultaneously impact the golf ball, said ridges being arranged such that both of said impact modes impart a vertical spin to the golf ball.

5. A putter head as claimed in claim 4 having three of said ridges on each of said opposing faces of said putter head including an upper ridge, a middle ridge and a lower ridge, said ridges being equally spaced from one another for any one of upper ridge impact, middle ridge impact and lower ridge impact when in the single ridge impact mode and for either one of combination upper and middle ridge impact and lower and middle ridge impact when in the multiple ridge impact mode.

6. A putter head as claimed in claim 5 wherein said ridges are coplanar with one another.

7. For use in a putter, a symmetrical putting head having two opposing ball striking faces each of which comprises a plurality of horizontally extending vertically separated face portions, said face portions being arranged for striking a golf ball in either one of a single face portion impact mode and a dual face portion impact made where adjacent face portions substantially simultaneously strike the golf ball to impart a vertical spin to the ball in both of said impact modes.

8. A putter with a putter head having a plurality of horizontally extending ridges on at least one face thereof, said putter head being formed from a plurality of putter sections having spaced apart edge regions for forming said ridges, said ridges being substantially parallel to and vertically gapped from one another to provide separate and distinct impact surfaces on said putter head for impacting a golf ball in either one of two different modes including a single ridge impact mode and a multiple ridge impact mode where at least two ridges simultaneously impact the golf ball; said ridges being arranged such that both of said impact modes impart a vertical spin to the golf ball and a sight on said putter head for vertical alignment of said putter.

9. A putter head as claimed in claim 8 wherein said sight comprises an upper aperture and a lower sight member in said putter sections, said upper aperture and said lower sight member being arranged such that said putter is vertically aligned when said lower sight member is centered with respect to said upper aperture.

10.

A putter head as claimed in claim 9 including cross hairs at said upper aperture for centering of said lower sight member therewith.

11. A putter having a putter head with a plurality of horizontally extending ridges on at least one face thereof said putter head being formed from a plurality of putter sections having spaced apart edge regions for forming said ridges; said ridges being substantially parallel to and vertically gapped from one another to provide separate and distinct impact surfaces on said putter head for impacting a golf ball in either one of two different modes including a single ridge impact mode and a multiple ridge impact mode where at least two ridges simultaneously impact the golf ball; said ridges being arranged such that both of said impact modes impart a vertical spin to the golf ball; said putter including a putter shaft between said putter sections and wherein said putter sections are separated from one another other than at said shaft for resonation thereof when impacting the golf ball.

* * * * *